US006223423B1

(12) United States Patent
Hogge

(10) Patent No.: US 6,223,423 B1
(45) Date of Patent: May 1, 2001

(54) MULTILAYER CONDUCTIVE POLYMER POSITIVE TEMPERATURE COEFFICIENT DEVICE

(75) Inventor: Steven Darryl Hogge, Corona, CA (US)

(73) Assignee: Bourns Multifuse (Hong Kong) Ltd. (HK)

( * ) Notice: Subject to any disclaimer, the term of this patent is extended or adjusted under 35 U.S.C. 154(b) by 0 days.

(21) Appl. No.: 09/393,092

(22) Filed: Sep. 9, 1999

Related U.S. Application Data

(62) Division of application No. 08/922,974, filed on Sep. 3, 1997, now abandoned.

(51) Int. Cl.[7] ..... H01C 17/28

(52) U.S. Cl. ..... 29/621; 338/22 R; 338/312; 338/313; 338/203; 29/610.1; 29/612

(58) Field of Search ..... 29/612, 620, 621.1, 29/610.1; 338/22 R, 25, 254, 307, 319, 328, 332; 219/505

(56) References Cited

U.S. PATENT DOCUMENTS

| | | | |
|---|---|---|---|
| H415 | 1/1988 | Newnham et al. | 338/22 R |
| 2,861,163 | 11/1958 | Asakawa | 201/72 |
| 2,978,665 | 4/1961 | Vernet et al. | 338/223 |
| 3,061,501 | 10/1962 | Dittman et al. | 156/250 |
| 3,138,686 | 6/1964 | Mitoff et al. | 200/142 |
| 3,187,164 | 6/1965 | Andrich | 219/504 |
| 3,243,753 | 3/1966 | Kohler | 338/31 |
| 3,351,882 | 11/1967 | Kohler et al. | 338/322 |
| 3,571,777 | 3/1971 | Tully et al. | 338/20 |
| 3,619,560 | 11/1971 | Bolting et al. | 219/300 |

(List continued on next page.)

FOREIGN PATENT DOCUMENTS

| | | | |
|---|---|---|---|
| 2838508 | 3/1980 | (DE) | H01C/7/02 |
| 0158410 | 10/1985 | (EP) | H05B/3/10 |
| 0311142 | 12/1989 | (EP) | H01C/1/14 |
| 833350 | 4/1998 | (EP) | H01C/1/14 |
| 1167551 | 10/1959 | (GB) | H05B/3/10 |
| 1172718 | 3/1969 | (GB) | H02H/2/08 |
| 1458720 | 12/1976 | (GB) | H01C/1/02 |
| 1561355 | 2/1980 | (GB) | C08J/3/24 |
| 1604735 | 6/1981 | (GB) . | |
| 64-47534 | 2/1989 | (JP) | 156/244 |
| 98/12715 | 3/1998 | (WO) | H01C/9/02 |
| 98/29879 | 7/1998 | (WO) | H01C/7/02 |
| 99/03113 | 1/1999 | (WO) | H01C/1/14 |

OTHER PUBLICATIONS

Japanese Patent Application No. 49–82736, Aug. 9, 1974.

Saburi, O. "Proscessing Techniques and Applications of Positive Temperature Coefficient Thermistors", *IEEE Transactions on Component Parts*, pp. 53–67 (1963).

(List continued on next page.)

*Primary Examiner*—Lee Young
*Assistant Examiner*—Sean Smith
(74) *Attorney, Agent, or Firm*—Klein & Szekeres, LLP

(57) ABSTRACT

A conductive polymer PTC device includes upper, lower, and center electrodes, with a first PTC conductive polymer layer between the upper and center electrodes, and a second PTC conductive polymer layer between the center and lower electrodes. Each of the upper and lower electrodes is separated into an isolated portion and a main portion. The isolated portions of the upper and lower electrodes are electrically connected to each other and to the center electrode by an input terminal. Upper and lower output terminals are provided, respectively, on the main portions of the upper and lower electrodes and are electrically connected to each other. The resulting device is, effectively, two PTC devices connected in parallel, thereby providing an increased effective cross-sectional area for the current flow path, and thus a larger hold current, for a given footprint.

5 Claims, 2 Drawing Sheets

U.S. PATENT DOCUMENTS

| | | | | |
|---|---|---|---|---|
| 3,654,533 | | 4/1972 | della Porta et al. | 317/258 |
| 3,673,121 | | 6/1972 | Meyer | 252/511 |
| 3,689,736 | | 9/1972 | Meyer | 219/222 |
| 3,745,507 | | 7/1973 | Ishida et al. | 338/25 |
| 3,760,495 | | 9/1973 | Meyer | 29/610 |
| 3,823,217 | | 7/1974 | Kampe | 264/105 |
| 3,824,328 | | 7/1974 | Ting et al. | 174/52.5 |
| 3,858,144 | | 12/1974 | Bedard et al. | 338/22 R |
| 3,861,029 | | 1/1975 | Smith-Johannsen et al. | 29/611 |
| 3,878,501 | | 4/1975 | Moorhead | 338/22 R |
| 3,914,363 | | 10/1975 | Bedard et al. | 264/105 |
| 3,976,600 | | 8/1976 | Meyr | 252/511 |
| 4,101,862 | | 7/1978 | Takagl et al. | 338/23 |
| 4,151,126 | | 4/1979 | Adelman et al. | 252/508 |
| 4,151,401 | | 4/1979 | Van Bokestal et al. | 219/508 |
| 4,177,376 | | 12/1979 | Horsma et al. | 219/553 |
| 4,177,446 | | 12/1979 | Diaz | 338/212 |
| 4,237,441 | | 12/1980 | van Konynenberg et al. | 318/22 R |
| 4,238,812 | | 12/1980 | Middleman et al. | 361/106 |
| 4,246,468 | | 1/1981 | Horsma | 219/553 |
| 4,250,398 | | 2/1981 | Ella et al. | 219/345 |
| 4,255,698 | | 3/1981 | Simon | 320/35 |
| 4,272,471 | | 6/1981 | Walker | 264/104 |
| 4,313,996 | | 2/1982 | Newman | 156/244 |
| 4,314,230 | | 2/1982 | Cardinal et al. | 338/314 |
| 4,314,231 | | 2/1982 | Wally | 338/328 |
| 4,315,237 | | 2/1982 | Middleman et al. | 338/22 R |
| 4,317,027 | | 2/1982 | Middleman et al. | 219/553 |
| 4,327,351 | | 4/1982 | Walker | 338/22 R |
| 4,329,726 | | 5/1982 | Middleman et al. | 361/58 |
| 4,341,949 | | 7/1982 | Steiner et al. | 219/553 |
| 4,348,584 | | 9/1982 | Gale et al. | 219/514 |
| 4,352,083 | | 9/1982 | Middleman et al. | 338/23 |
| 4,388,607 | | 6/1983 | Toy et al. | 338/22 |
| 4,413,301 | | 11/1983 | Middleman et al. | 361/106 |
| 4,426,339 | | 1/1984 | Kamath et al. | 264/22 |
| 4,426,633 | | 1/1984 | Taylor | 338/25 |
| 4,439,918 | | 4/1984 | Carroll, II et al. | 29/840 |
| 4,444,708 | | 4/1984 | Gale et al. | 264/105 |
| 4,445,026 | | 4/1984 | Walker | 219/553 |
| 4,475,138 | | 10/1984 | Middleman et al. | 361/58 |
| 4,481,498 | | 11/1984 | McTavish et al. | 338/20 |
| 4,490,218 | | 12/1984 | Kadija et al. | 204/13 |
| 4,521,265 | | 6/1985 | Kunihiko | 156/324 |
| 4,534,889 | | 8/1985 | van Konynenburg et al. | 252/511 |
| 4,542,365 | | 9/1985 | McTavish et al. | 338/20 |
| 4,545,926 | | 10/1985 | Fouts, Jr. et al. | 252/511 |
| 4,560,498 | | 12/1985 | Horsma et al. | 252/511 |
| 4,639,818 | | 1/1987 | Cherian | 361/106 |
| 4,647,894 | | 3/1987 | Ratell | 338/33 R |
| 4,647,896 | | 3/1987 | Ratell | 338/22 R |
| 4,652,325 | | 3/1987 | Benge | 156/244 |
| 4,654,511 | | 3/1987 | Horsma et al. | 219/548 |
| 4,685,025 | | 8/1987 | Carlomagno | 361/106 |
| 4,689,475 | | 8/1987 | Kleiner et al. | 219/553 |
| 4,698,614 | | 10/1987 | Welch et al. | 338/22 R |
| 4,706,060 | | 11/1987 | May | 338/20 |
| 4,732,701 | | 3/1988 | Nishii et al. | 252/511 |
| 4,752,762 | | 6/1988 | Inano et al. | 338/22 R |
| 4,755,246 | | 7/1988 | Monio | 156/244 |
| 4,766,409 | * | 8/1988 | Mandai | 338/22 R |
| 4,769,901 | | 9/1988 | Nagahori | 29/621 |
| 4,774,024 | | 9/1988 | Deep et al. | 252/511 |
| 4,787,135 | | 11/1988 | Nagahori | 29/612 |
| 4,800,253 | | 1/1989 | Kleiner et al. | 219/553 |
| 4,811,164 | | 3/1989 | Ling et al. | 361/321 |
| 4,845,838 | | 7/1989 | Jacobs et al. | 29/671 |
| 4,849,133 | | 7/1989 | Yoshida et al. | 252/511 |
| 4,876,439 | | 10/1989 | Nagahori | 219/541 |
| 4,882,466 | | 11/1989 | Friel | 219/219 |
| 4,884,163 | | 11/1989 | Deep et al. | 361/58 |
| 4,904,850 | | 2/1990 | Claypool et al. | 219/548 |
| 4,907,340 | | 3/1990 | Fang et al. | 29/610 |
| 4,924,074 | | 5/1990 | Fang et al. | 219/548 |
| 4,937,551 | | 6/1990 | Plasko | 338/22 R |
| 4,942,286 | | 7/1990 | Monter et al. | 219/219 |
| 4,951,382 | | 8/1990 | Jacobs et al. | 29/611 |
| 4,951,384 | | 8/1990 | Jacobs et al. | 29/611 |
| 4,954,696 | | 9/1990 | Ishii et al. | 219/548 |
| 4,955,267 | | 9/1990 | Jacobs et al. | 29/611 |
| 4,959,505 | | 9/1990 | Ott | 174/52.2 |
| 4,967,176 | | 10/1990 | Horsma et al. | 338/22 R |
| 4,980,541 | | 12/1990 | Shafe et al. | 219/548 |
| 4,983,944 | | 1/1991 | Uchida et al. | 338/22 R |
| 5,015,824 | | 5/1991 | Monter et al. | 219/219 |
| 5,039,844 | | 8/1991 | Nagahorl | 219/541 |
| 5,049,850 | | 9/1991 | Evans | 338/22 R |
| 5,057,674 | | 10/1991 | Smith-Johannsen | 219/553 |
| 5,064,997 | | 11/1991 | Fang et al. | 219/505 |
| 5,089,688 | | 2/1992 | Fang et al. | 219/505 |
| 5,089,801 | | 2/1992 | Chan et al. | 338/22 R |
| 5,140,297 | | 8/1992 | Jacobs et al. | 338/22 R |
| 5,142,267 | | 8/1992 | Fellner et al. | 338/23 |
| 5,148,005 | | 9/1992 | Fang et al. | 219/505 |
| 5,164,133 | | 11/1992 | Ishida et al. | 264/105 |
| 5,166,658 | | 11/1992 | Fang et al. | 338/23 |
| 5,171,774 | | 12/1992 | Ueno et al. | 524/495 |
| 5,173,362 | | 12/1992 | Tekkanat et al. | 428/283 |
| 5,174,924 | | 12/1992 | Yamada et al. | 252/511 |
| 5,178,797 | | 1/1993 | Evans | 252/508 |
| 5,181,006 | | 1/1993 | Shafe et al. | 338/22 R |
| 5,190,697 | | 3/1993 | Ohkita et al. | 252/511 |
| 5,195,013 | | 3/1993 | Jacobs et al. | 361/106 |
| 5,210,517 | | 5/1993 | Abe | 338/22 R |
| 5,212,466 | | 5/1993 | Yamada et al. | 338/22 R |
| 5,227,946 | | 7/1993 | Jacobs et al. | 361/106 |
| 5,241,741 | | 9/1993 | Sugaya | 29/612 |
| 5,247,277 | | 9/1993 | Fang et al. | 338/22 R |
| 5,250,228 | | 10/1993 | Baigrie et al. | 252/511 |
| 5,280,263 | | 1/1994 | Sugaya | 338/22 R |
| 5,285,570 | * | 2/1994 | Fulinara | 29/830 |
| 5,303,115 | | 4/1994 | Nayar et al. | 361/106 |
| 5,351,390 | | 10/1994 | Yamada et al. | 29/612 |
| 5,358,793 | | 10/1994 | Hanada et al. | 428/560 |
| 5,401,154 | | 3/1995 | Sargent | 425/114 |
| 5,699,607 | | 12/1997 | McGuire | 29/612 |
| 5,777,541 | | 7/1998 | Vakeman | 338/22 R |
| 5,802,709 | | 9/1998 | Hogge et al. | 29/827 |
| 5,812,048 | | 9/1998 | Ross, Jr. et al. | 338/128 |
| 5,831,510 | | 11/1998 | Zhang et al. | 338/22 R |
| 5,852,397 | | 12/1998 | Chan et al. | 338/22 R |
| 5,864,281 | | 1/1999 | Zhang et al. | 338/22 R |

OTHER PUBLICATIONS

Meyer, J. "Glass Transition Temperature as a Guide to Selection of Polymers Suitable for PTC Material", *Polymer Engineering And Science*, 13/6:462–468(Nov., 1973).

Meyer, J. (1974) "Stability of polymer composites as positive–temperature coefficient resistors" *Polymer Engineering and Science*, 14/10:706–716.

Arrowsmith, D. J. (1970) "Adhesion of Electroformed Copper and Nickel to Plastic Laminates", *Transactions of the Instituted of Metal Finishing*, vol. 48, pp. 88–92.

Bigg. D. M. et al. "Conductive Polymeric Composites from Short Conductive Fibers",Batelle Columbus Laboratories, pp 23–38.

* cited by examiner

MULTILAYER CONDUCTIVE POLYMER POSITIVE TEMPERATURE COEFFICIENT DEVICE

CROSS-REFERENCE TO RELATED APPLICATIONS

This application is a divisional application of Ser. No. 08/922,974, filed Sep. 3,1997 now abandoned.

FEDERALLY SPONSORED RESEARCH OR DEVELOPMENT

Not Applicable

BACKGROUND OF THE INVENTION

The present invention relates generally to the field of conductive polymer positive temperature coefficient (PTC) devices. More specifically, it relates to conductive polymer PTC devices that are of laminar construction, with more than a single layer of conductive polymer PTC material, and that are especially configured for surfacemount installations.

Electronic devices that include an element made from a conductive polymer have become increasingly popular, being used in a variety of applications. They have achieved widespread usage, for example, in overcurrent protection and self-regulating heater applications, in which a polymeric material having a positive temperature coefficient of resistance is employed. Examples of positive temperature coefficient (PTC) polymeric materials, and of devices incorporating such materials, are disclosed in the following U.S. Pat. Nos.:

3,823,217—Kampe
4,237,441—van Konynenburg
4,238,812—Middleman et al.
4,317,027—Middleman et al.
4,329,726—Middleman et al.
4,413,301—Middleman et al.
4,426,633—Taylor
4,445,026—Walker
4,481,498—McTavish et al.
4,545,926—Fouts, Jr. et al.
4,639,818—Cherian
4,647,894—Ratell
4,647,896—Ratell
4,685,025—Carlomagno
4,774,024—Deep et al.
4,689,475—Kleiner et al.
4,732,701—Nishii et al.
4,769,901—Nagahori
4,787,135—Nagahori
4,800,253—Kleiner et al.
4,849,133—Yoshida et al.
4,876,439—Nagahori
4,884,163—Deep et al.
4,907,340—Fang et al.
4,951,382—Jacobs et al.
4,951,384—Jacobs et al.
4,955,267—Jacobs et al.
4,980,541—Shafe et al.
5,049,850—Evans
5,140,297—Jacobs et al.

5,171,774—Ueno et al.
5,174,924—Yamada et al.
5,178,797—Evans
5,181,006—Shafe et al.
5,190,697—Ohkita et al.
5,195,013—Jacobs et al.
5,227,946—Jacobs et al.
5,241,741—Sugaya
5,250,228—Baigrie et al.
5,280,263—Sugaya
5,358,793—Hanada et al.

One common type of construction for conductive polymer PTC devices is that which may be described as a laminated structure. Laminated conductive polymer PTC devices typically comprise a single layer of conductive polymer material sandwiched between a pair of metallic electrodes, the latter preferably being a highly-conductive, thin metal foil. See, for example, U.S. Pat. Nos. 4,426,633—Taylor; 5,089,801—Chan et al.; 4,937,551—Plasko; and 4,787,135—Nagahori; and International Publication No. WO97/06660.

A relatively recent development in this technology is the multilayer laminated device, in which two or more layers of conductive polymer material are separated by alternating metallic electrode layers (typically metal foil), with the outermost layers likewise being metal electrodes. The result is a device comprising two or more parallel-connected conductive polymer PTC devices in a single package. The advantages of this multilayer construction are reduced surface area ("footprint") taken by the device on a circuit board, and a higher current-carrying capacity, as compared with single layer devices.

In meeting a demand for higher component density on circuit boards, the trend in the industry has been toward increasing use of surface mount components as a space-saving measure. Surface mount conductive polymer PTC devices heretofore available have been generally limited to hold currents below about 2.5 amps for packages with a board footprint that generally measures about 9.5 mm by about 6.7 mm. Recently, devices with a footprint of about 4.7 mm by about 3.4 mm, with a hold current of about 1.1 amps, have become available. Still, this footprint is considered relatively large by current surface mount technology (SMT) standards.

The major limiting factors in the design of very small SMT conductive polymer PTC devices are the limited surface area and the lower limits on the resistivity that can be achieved by loading the polymer material with a conductive filler (typically carbon black). The fabrication of useful devices with a volume resistivity of less than about 0.2 ohm-cm has not been practical. First, there are difficulties inherent in the fabrication process when dealing with such low volume resistivities. Second, devices with such a low volume resistivity do not exhibit a large PTC effect, and thus are not very useful as circuit protection devices.

The steady state heat transfer equation for a conductive polymer PTC device may be given as:

$$0=[I^2R(f(T_d))]-[U(T_d-T_a)], \quad (1)$$

where I is the steady state current passing through the device; $R(f(T_d))$ is the resistance of the device, as a function of its temperature and its characteristic "resistance/temperature function" or "R/T curve"; U is the effective heat transfer coefficient of the device; $T_d$ is temperature of the device; and $T_a$ is the ambient temperature.

The "hold current" for such a device may be defined as the value of I necessary to trip the device from a low resistance state to a high resistance state. For a given device, where U is fixed, the only way to increase the hold current is to reduce the value of R.

The governing equation for the resistance of any resistive device can be stated as $$R=\rho L/A, \quad (2)$$

where ρ is the volume resistivity of the resistive material in ohm-cm, L is the current flow path length through the device in cm, and A is the effective cross-sectional area of the current path in $cm^2$.

Thus, the value of R can be reduced either by reducing the volume resistivity ρ, or by increasing the cross-sectional area A of the device.

The value of the volume resistivity p can be decreased by increasing the proportion of the conductive filler loaded into the polymer. The practical limitations of doing this, however, are noted above.

A more practical approach to reducing the resistance value R is to increase the cross-sectional area A of the device. Besides being relatively easy to implement (from both a process standpoint and from the standpoint of producing a device with useful PTC characteristics), this method has an additional benefit: In general, as the area of the device increases, the value of the heat transfer coefficient also increases, thereby further increasing the value of the hold current.

In SMT applications, however, it is necessary to minimize the effective surface area or footprint of the device. This puts a severe constraint on the effective cross-sectional area of the PTC element in device. Thus, for a device of any given footprint, there is an inherent limitation in the maximum hold current value that can be achieved. Viewed another way, decreasing the footprint can be practically achieved only by reducing the hold current value.

There has thus been a long-felt, but as yet unmet, need for very small footprint SMT conductive polymer PTC devices that achieve relatively high hold currents.

SUMMARY OF THE INVENTION

Broadly, the present invention is a conductive polymer PTC device that has a relatively high hold current while maintaining a very small circuit board footprint. This result is achieved by a multilayer construction that provides an increased effective cross-sectional area A of the current flow path for a given circuit board footprint. In effect, the multilayer construction of the invention provides, in a single, smallfootprint surface mount package, two or more PTC devices electrically connected in parallel.

In one aspect, the present invention is a conductive polymer PTC device comprising, in a preferred embodiment, five alternating layers of metal foil and PTC conductive polymer, with electrically conductive interconnections to form two conductive polymer PTC devices connected to each other in parallel, and with termination elements configured for surface mount termination.

Specifically, two of the foil layers form, respectively, upper and lower electrodes, while the third foil layer forms a center electrode. A first conductive polymer layer is located between the upper and center electrodes, and a second conductive polymer layer is located between the center and lower electrodes. Each of the upper and lower electrodes is separated into an isolated portion and a main portion. The isolated portions of the upper and lower electrodes are electrically connected to each other and to the center electrode by an input terminal. Upper and lower output terminals are provided, respectively, on the main portions of the upper and lower electrodes. The upper and lower output terminals are electrically connected to each other, but they are electrically isolated from the center electrode.

The current flow path of this device is from the input terminal to the center electrode, and then through each of the conductive polymer layers to the output terminals. Thus, the resulting device is, effectively, two PTC devices connected in parallel. This construction provides the advantages of a significantly increased effective cross-sectional area for the current flow path, as compared with a single layer device, without increasing the footprint. Thus, for a given footprint, a larger hold current can be achieved.

In another aspect, the present invention is a method of fabricating the above-described device. This method comprises the steps of: (1) providing a laminate comprising upper, lower, and center metal foil electrode layers, with the upper and center electrode layers separated by a first PTC layer of conductive polymer, and the center and lower electrode layers separated by a second PTC layer of conductive polymer; (2) separating an electrically isolated portion of each of the upper and lower electrode layers from a main portion of the upper and lower electrode layers; (3) forming an input terminal electrically connecting the isolated portions of the upper and lower electrode layers to each other and to the center electrode layer; (4) forming an upper output terminal on the main portion of the upper electrode layer and a lower output terminal on the main portion of the lower electrode layer; and (5) electrically connecting the upper and lower output terminals to each other. In performing the last-named step, the center electrode must be maintained electrically isolated from both of the output terminals.

The above-mentioned advantages of the present invention, as well as others, will be more readily appreciated from the detailed description that follows.

DETAILED DESCRIPTION OF THE INVENTION

Figure 1:
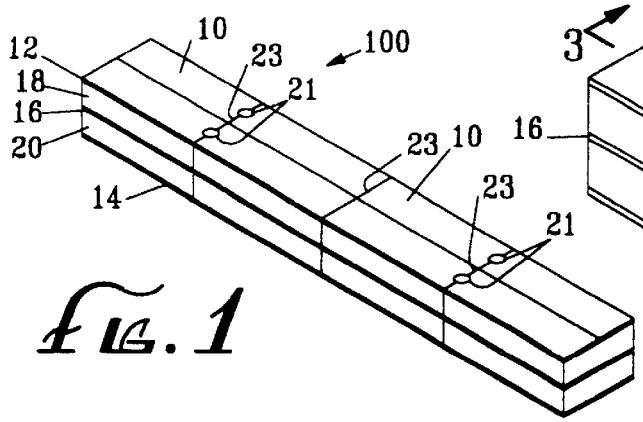
FIG. 1 is a perspective view of a laminated web of alternating metal foil and conductive polymer layers, upon which the steps of the fabrication method of the invention are performed prior to the step of singulation into individual laminated units.

Referring now to the drawings, FIG. 1 illustrates a laminated web 100 that is provided as the initial step in the process of fabricating a conductive polymer PTC device in accordance with the present invention. The laminated web 100 comprises five alternating layers of metal foil and a conductive polymer with the desired PTC characteristics. Specifically, the laminated web 100 comprises an upper foil layer 12, a lower foil layer 14, a center foil layer 16, a first conductive polymer layer 18 between the upper foil layer 12 and the center foil layer 16, and a second conductive polymer layer 20 between the center foil layer 16 and the lower foil layer 14.

The conductive polymer layers 18, 20 may be made of any suitable conductive polymer composition, such as, for example, high density polyethylene (HDPE) into which is mixed an amount of carbon black that results in the desired electrical operating characteristics. See, for example, International Publication No. WO97/06660, assigned to the assignee of the present invention, the disclosure of which is incorporated herein by reference.

The foil layers 12, 14, and 16 may be made of any suitable metal foil, with copper being preferred, although other metals, such as nickel, are also acceptable. If the foil layers 12, 14, and 16 are made of copper foil, those foil surfaces that contact the conductive polymer layers are coated with a nickel flash coating (not shown) to prevent unwanted chemical reactions between the polymer and the copper. These polymer contacting surfaces are also preferably "modularized", by well-known techniques, to provide a roughened surface that provides good adhesion between the foil and the polymer.

The laminated web 100 may itself be formed by any of several suitable processes that are known in the art, as exemplified by U.S. Pat. Nos. 4,426,633—Taylor; 5,089,801—Chan et al.; 4,937,551 Plasko; and 4,787,135—Nagahori; and International Publication No. WO97/06660. Some modification of these processes may be required to form a structure of five layers, rather than the usual three. For example, the process described in International Publication No. WO97/06660 can be employed by first forming a three layer (foil-polymer-foil) laminated web in accordance with the process as described in that publication, and then taking the three layer web and, in accordance with that process, laminating it to one side of a second extruded conductive polymer web, with a third foil web laminated to the other side. Alternatively, a coextrusion process can be employed, whereby multiple layers of PTC conductive polymer material and metal foil are formed and laminated simultaneously.

Figure 2:
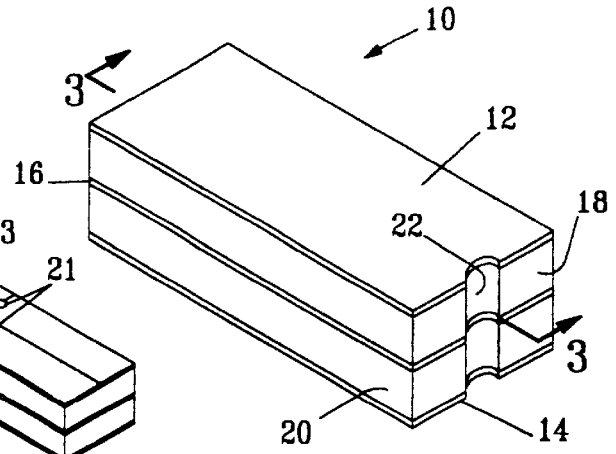
FIG. 2 is a perspective view of one of the individual laminated units formed in the web shown in FIG. 1, showing the unit at the stage in the process illustrated in FIG. 1, the individual unit being shown for the purpose of illustrating the steps in the method of fabricating a conductive polymer PTC device in accordance with the present invention.
Figure 4:
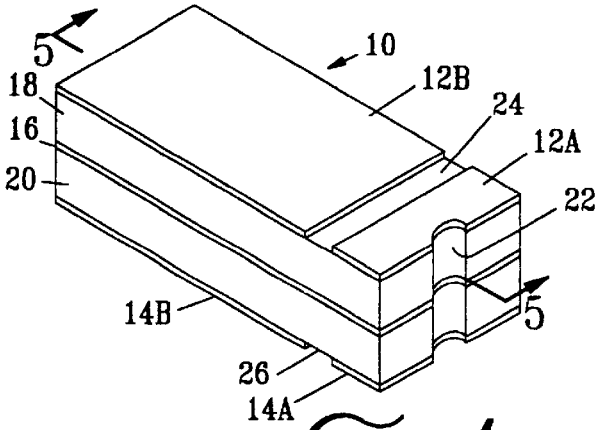
FIG. 4 is a perspective view similar to that of FIG. 2, showing the next step in the process of the invention.
Figure 5:
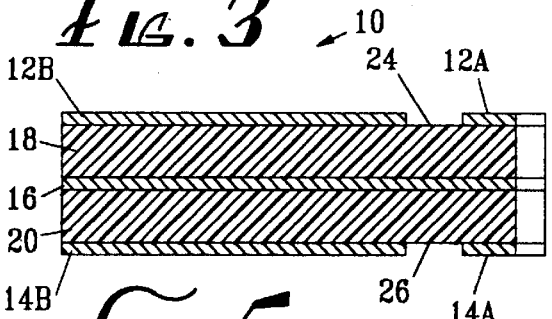
FIG. 5 is a cross-sectional view taken along line 5—5 of FIG. 4.
Figure 6:
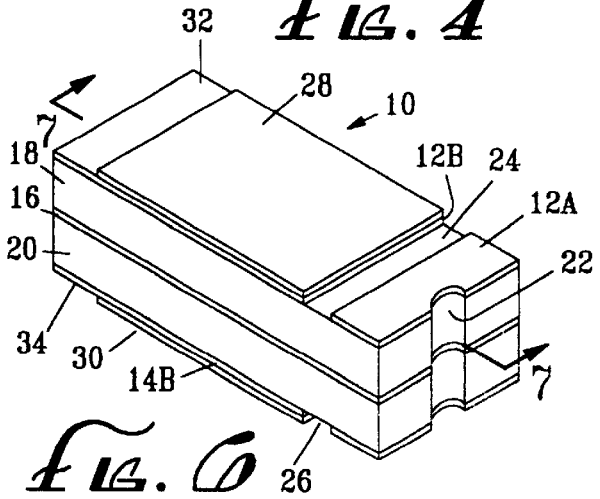
FIG. 6 is a perspective view similar to that of FIG. 4, showing the next step in the process of the invention.

The result of the lamination process is the five-layer laminated web 100 of FIG. 1. It is upon this web 100 that the process steps described below, prior to the step of attaching the terminal leads, are performed. It will thus be understood that FIGS. 2 through 11 show an individual laminated unit 10 only for the sake of clarity, although the laminated unit is, in actuality, a part of the web 100 of FIG. 1 through the steps illustrated in FIGS. 2 through 11. Accordingly, the individual laminated unit 10 shown in the drawings is not separated ("singulated") from the web 100 until all of the process steps before the attachment of the terminal leads have been completed. After the five-layer laminated web 100 has been formed by any suitable process, an array of apertures 21 is formed in it. These apertures 21 can be formed by any suitable method, such as drilling or punching. As shown in FIG. 1, the apertures 21 are spaced on alternate transverse score lines 23, so that each aperture 21 forms a pair of complementary semicircular channels 22 in each adjoining pair of laminated units 10. Thus, after singulation, each of the laminated units 10 has a semicircular channel 22 in one end, as best shown in FIGS. 2, 4, and 6.

Figure 3:
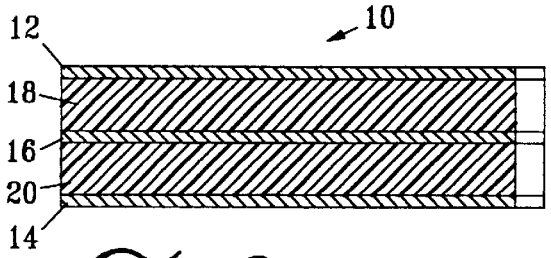
FIG. 3 is a cross-sectional view taken along line 3—3 of FIG. 2.

FIGS. 2 and 3 show what an individual laminated unit 10 would look like at the stage in the process illustrated in FIG. 1. Referring now to FIGS. 4 and 5, the next process step is the separation of an electrically isolated portion of each of the upper and lower foil layers from a main portion of the upper and lower foil layers. This is accomplished by using standard printed circuit board assembly techniques, employing photo-resist and etching methods well known in the art. The result is the separation of the upper foil layer 12 into an isolated upper electrode portion 12*a* and a main upper electrode portion 12*b*, and the separation of the lower foil layer 14 into an isolated lower electrode portion 14*a* and a main lower electrode portion 14*b*. The isolated electrode portions 12*a*, 14*a* are separated from their respective main electrode portions 12*b*, 14*b* by upper and lower isolation gaps 24, 26, the width and configuration of which may depend upon the desired electrical characteristics of the finished device.

Figure 7:
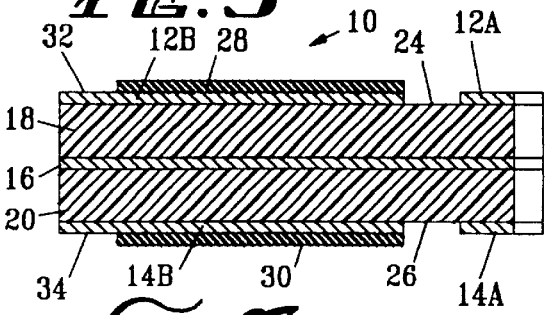
FIG. 7 is a cross-sectional view taken along line 7—7 of FIG. 6.

FIGS. 6 and 7 illustrate the step of applying upper and lower electrically isolating barriers 28, 30 to the upper and lower main electrode portions 12*b*, 14*b*, respectively. The barriers 28, 30 are formed of thin layers of insulating material, such as, for example, glassfilled epoxy resin, which may be applied to or formed on the respective upper and lower main electrode portions 12*b*, 14*b* by conventional techniques, well known in the art. The upper and lower isolating barriers 28, 30 respectively cover substantially the entire upper and lower main electrode portions 12*b*, 14*b*, except for upper and lower uncovered areas 32, 34 adjacent the edges of the upper and lower main electrode portions 12*b*, 14*b*, respectively. The isolating barriers 28, 30 may extend into the upper and lower isolating gaps 24, 26, respectively.

Figure 9:
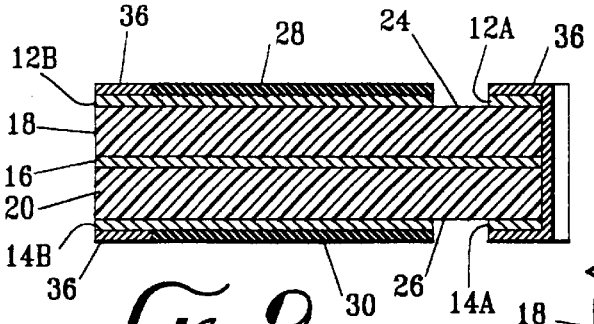
FIG. 9 is a cross-sectional view taken along line 9—9 of FIG. 8.
Figure 8:
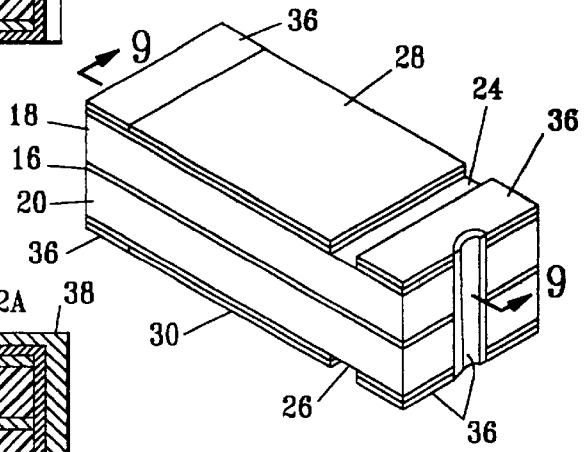
FIG. 8 is a perspective view similar to that of FIG. 6, showing the next step in the process of the invention.

FIGS. 8 and 9 illustrate the first of two metallic plating steps. The metallic plating in the first plating step is preferably copper, although tin or nickel may also be used. In this step, a first plating layer 36 is applied to those portions of the upper and lower foil layers 12, 14 not covered by the isolation barriers 28, 30, namely, the upper and lower isolated electrode portions 12*a*, 14*a*, and the upper and lower uncovered areas 32, 34 of the upper and lower main electrode portions 12*b*, 14*b*. This first plating layer 36 also covers the peripheral surfaces of the apertures 22, thereby electrically connecting the upper and lower isolated electrode portions 12*a*, 14*a* to each other and to the center foil layer 16. The application of the first plating layer 36 may be by any well-known plating technique deemed suitable for this application.

Figure 11:
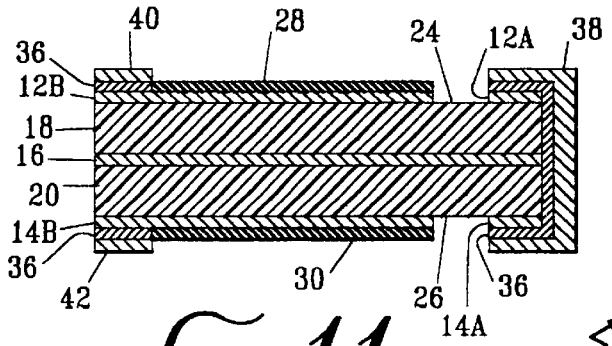
FIG. 11 is a cross-sectional view taken along line 11—11 of FIG. 10.
Figure 10:
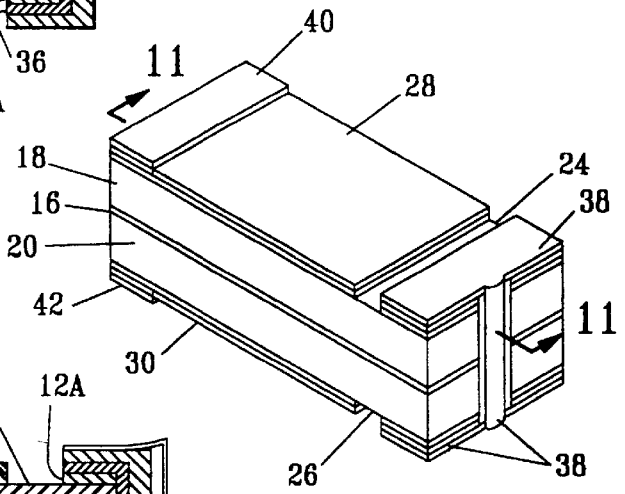
FIG. 10 is a perspective view similar to that of FIG. 8, showing the next step the process of the invention.

FIGS. 10 and 11 illustrate the second of the two metallic plating steps, in which a solder layer is applied on top of the first plating layer 36, including that portion of the first plating layer 36 located in the apertures 22. This step results in the forming of an input terminal 38 electrically connecting the upper and lower isolated electrode portions 12*a*, 14*a* to each other and to the center foil layer 16, the last-named becoming a center electrode. This second plating step also results in the forming of upper and lower output terminals 40, 42 on the upper and lower main electrode portions 12*b*, 14*b*, respectively. The upper and lower output terminal 40, 42 are electrically isolated from each other and from the center electrode 16. As with the first plating step, the second plating step can be performed by any well-known technique found suitable for this purpose.

At this point, the aforementioned step of singulation is performed, whereby the individual laminated units 10, at the stage of fabrication shown in FIGS. 10 and 11, are separated from the laminated web 100 upon which all of the previously described process steps have been performed. Alternatively, the laminated units 10 may be left in a strip the width of only single device.

Figure 12:
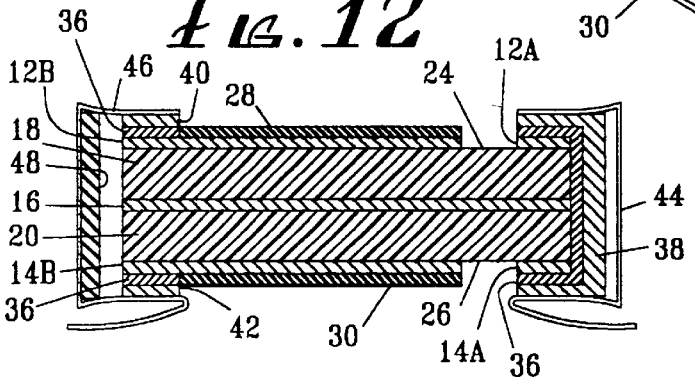
FIG. 12 is a sectional view of a completed conductive polymer PTC device in accordance with a preferred embodiment of the present invention.

Finally, as shown in FIG. 12, an input lead 44 is attached to the input terminal 38, and an output lead 46 is attached to the upper and lower output terminals 40, 42. Electrical isolation of the output lead 46 from the center electrode 16 may be achieved either by the geometry of the output lead 46, or by the application of an insulating layer 48 to the output lead 46. As shown in FIG. 11, both isolation techniques can be used. The leads 44, 46 may be configured for through-hole board mounting, or, preferably, as shown in FIG. 11, for surface mount board attachment. The leads 44, 46 may be shaped for the specific mounting application either before or after attachment to their respective terminals. Upon the attachment of the leads 44, 46 the fabrication of a conductive polymer PTC device 50 is completed.

When employed in a circuit containing a component to be protected from an overcurrent or like situation, the current flow path through the device 50 is from the input terminal 38 to the center electrode 16, and then through each of the conductive polymer layers 18, 20 to the upper and lower output terminals 40, 42, respectively. Thus, the device 50 is, effectively, two PTC devices connected in parallel. This construction provides the advantages of a significantly increased effective cross-sectional area for the current flow path, as compared with a single layer device, without increasing the footprint. Thus, for a given footprint, a larger hold current can be achieved.

It will thus be appreciated that the present invention may be implemented as an SMT device with a very small footprint that achieves relatively high hold currents.

While a preferred embodiment of the invention has been described herein, it will be appreciated that this embodiment, as well as its method of manufacture, as described above, is exemplary only. Modifications and variations in the structure of the device and its method of manufacture will suggest themselves to those skilled in the pertinent arts. Such modifications and variations are considered to be within the spirit and scope of the present invention, as defined in the claims that follow.

What is claimed is:

1. A method of fabricating a multilayer conductive polymer PTC device, comprising the steps of:

(a) forming a laminated structure by laminating a first conductive polymer PTC layer between an upper metal foil electrode layer and a center metal foil electrode layer, and a second conductive polymer PTC layer between the center metal foil electrode layer and a lower metal foil electrode layer;

(b) separating an electrically isolated portion of each of the upper and lower electrode layers from a main portion of the upper and lower electrode layers;

(c) forming an input terminal electrically connecting the isolated portions of the upper and lower electrode layers to each other and to the center electrode layer;

(d) forming an upper output terminal on the main portion of the upper electrode layer and a lower output terminal on the main portion of the lower electrode layer; and (e) electrically connecting the upper and lower output terminals to each other.

2. The method of claim 1, wherein the step of electrically connecting the upper and lower output terminals to each other maintains an electrical isolation between the center electrode layer and the upper and lower output terminals.

3. The method of claim 1, wherein the laminated structure is provided with an end surface having a channel extending through the isolated portions of the upper and lower electrode layers, through the center electrode layer, and through the first and second PTC layers, and wherein the step of forming the input terminal comprises the step of forming the input terminal in the channel.

4. The method of claim 1, wherein the step of separating the electrically isolated portion of each of the upper and lower electrode layers from the main portion of the upper and lower electrode layers is performed by forming a first gap in the upper electrode layer and a second gap in the lower electrode layer.

5. The method of claim 3, wherein, before the step of forming the upper and lower output terminals, the method includes the step of forming an upper isolation barrier layer on the main portion of the upper electrode layer and a lower isolation barrier on the main portion of the lower electrode layer, the upper and lower isolation barriers being dimensioned so that the upper output terminal is formed on a part of the upper electrode layer on which the upper isolation barrier is not formed, and so that the lower output terminal is formed on a part of the lower electrode layer on which the lower isolation barrier is not formed.

* * * * *

UNITED STATES PATENT AND TRADEMARK OFFICE

CERTIFICATE OF CORRECTION

PATENT NO. : 6,223,423 B1
DATED : May 1, 2001
INVENTOR(S) : Hogge

It is certified that error appears in the above-identified patent and that said Letters Patent is hereby corrected as shown below:

Title page,
Related U.S. Application Data, line 2, delete "now abandoned".

Column 1,
Line 10, delete "now abandoned".

Column 3,
Line 49, "smallfootprint" should be -- small footprint --.

Column 4,
Line 67, insert -- in -- following the word "step".

Column 5,
Line 3, "sectional" should be -- cross-sectional --.
Line 38, "modularized" should be -- nodularized --.

Column 6,
Line 35, "glassfilled" should be -- glass-filled --.

Column 8,
Line 40, "Claim 3" should be -- Claim 4 --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*